US006955730B2

(12) United States Patent
Bockel-Macal et al.

(10) Patent No.: US 6,955,730 B2
(45) Date of Patent: Oct. 18, 2005

(54) METHOD FOR ENHANCING THE METALLURIGCAL QUALITY OF PRODUCTS TREATED IN A FURNACE

(75) Inventors: Savine Bockel-Macal, Villebon S/Yvette (FR); Olivier Delabroy, Paris (FR); Olivier Louedin, Breuillet (FR); Christel Champinot, Boulogne Billancourt (FR)

(73) Assignee: L'Air Liquide, Société Anonyme á Directoire et Conseil de Surveillance pour l'Etude et l'Exploitation des Procédés Georges Claude, Paris (FR)

( * ) Notice: Subject to any disclaimer, the term of this patent is extended or adjusted under 35 U.S.C. 154(b) by 36 days.

(21) Appl. No.: 10/475,149

(22) PCT Filed: Apr. 19, 2002

(86) PCT No.: PCT/FR02/01361

§ 371 (c)(1),
(2), (4) Date: Mar. 22, 2004

(87) PCT Pub. No.: WO02/088402

PCT Pub. Date: Nov. 7, 2002

(65) Prior Publication Data

US 2004/0140024 A1 Jul. 22, 2004

(30) Foreign Application Priority Data

Apr. 26, 2001 (FR) ..... 01 05634
Apr. 26, 2001 (FR) ..... 01 05633

(51) Int. Cl.[7] ..... C21D 1/00

(52) U.S. Cl. ..... 148/511; 148/663; 266/81; 266/87

(58) Field of Search ..... 148/511, 663; 266/81, 87

(56) References Cited

U.S. PATENT DOCUMENTS 4,357,135 A 11/1982 Wilde et al.
4,415,415 A 11/1983 Zaremski
4,606,529 A * 8/1986 Tooch ..... 266/80

FOREIGN PATENT DOCUMENTS

EP 0 630 978 12/1994
EP 0 767 353 4/1997
FR 2 174 657 10/1973
FR 2 794 132 12/2000

OTHER PUBLICATIONS

International Search Report for PCT/FR02/01361.
Upschulte, B L et al. Applied Optics vol. 38 No. 9, pp. 1506–1512, Mar. 20, 1999.

* cited by examiner

*Primary Examiner*—Melvyn Andrews
(74) *Attorney, Agent, or Firm*—Linda K. Russell

(57) ABSTRACT

The method and apparatus for enhancing the metallurgical quality of products treated in a furnace with several zones, wherein the temperature and the atmospheric conditions can be controlled. The applies to any type of product treated in a furnace, such as billets, blooms, slugs or slabs. Alternatively, this may be used by iron and steel manufacturers in the production line for sheets, plates, tubes, etc.

21 Claims, 7 Drawing Sheets

METHOD FOR ENHANCING THE METALLURIGCAL QUALITY OF PRODUCTS TREATED IN A FURNACE

BACKGROUND OF THE INVENTION

1. Field of the Invention

The invention relates to a method for enhancing the metallurgical quality of products treated in a furnace, and especially a reheat furnace. This invention applies to any type of product, but more particularly to products treated in a reheat furnace, such as, for example, billets, blooms, slugs or slabs, or any other product used by iron and steel manufacturers in their production line (such as sheet or plate, tube, etc.). The invention relates more particularly to a method of treating a metallurgical product in a furnace, in which the product be treated is introduced into the furnace and then subjected to the desired treatment before being removed from the furnace, the furnace comprising heating means and especially burners for raising the various zones of the furnace to a variable temperature, it being possible for the atmosphere in these various zones to have an identical or different composition depending on the zones in question of said furnace.

2. Related Art

The environment of a steel (or any other product, especially a metal or iron or steel product), when it is raised to a high temperature during a heat treatment, is often an atmosphere which is oxidizing with respect to the metal. This situation may result, on the one hand, in oxidation of the metal with the formation of a surface layer of scale and, on the other hand, in decarburization of the steel with the creation of a carbon concentration gradient near the surface of the workpiece.

The altered region at the surface of these workpieces is essentially composed of two parts (see FIG. 1), one lying on the atmosphere side (upper scale) and the other adjacent the metal (hybrid region).

The upper part generally is composed of three dense oxide layers: a layer of oxide $Fe_2O_3$ (hematite), which is very thin (with a thickness of a few microns), a layer of magnetite ($Fe_3O_4$) (about 4% of the total scale) and a thick layer of the oxide FeO (wustite) (about 95% of the total scale) which is of greater or lesser porosity depending on the reheat time and the reheat temperature.

The growth of this scale, which follows a parabolic law, is controlled by the diffusion of $Fe^{2+}$ ions into the wustite and the magnetite and by the diffusion of oxygen $O_2^-$ into the hematite.

The lower part, or hybrid region, has a greater or lesser thickness depending on the nature of the steel. It is located at the metal/scale interface and consists of a mixture of FeO and products resulting from the reaction of FeO with the oxides of certain alloying elements. This lower part is also composed of a metal region altered by various phenomena, such as decarburization or internal oxidation. Decarburization is a phenomenon involving the solid-state diffusion of carbon, which reacts with the FeO scale (and/or $H_2O$). The permeability of industrial scale to the gaseous products resulting from the oxidation of carbon (especially CO) makes this oxidation at the surface of the metal almost immediate. Decarburization is therefore limited by the diffusion of carbon at the treatment temperature and is favored by the ability of the gases formed (CO) to escape from the scale-steel interface.

Depending on the thermal profile imposed and on the composition of the atmosphere (especially the $O_2$, $H_2O$ and $CO_2$ contents), the iron or steel products may be oxidized (scale) and decarburized (this being the more so in the case of high-carbon steels). In both cases, the steel manufacturer will have to subject his workpieces to an additional operation aimed at eliminating these surface defects. Whereas the oxide layer may be removed by various descaling techniques, the decarburized layer, that forms an integral part of the workpiece, cannot be easily "erased": the surface of the product is devoid of some of its carbon atoms, thereby degrading the mechanical properties on the surface of the product (longevity, hardness, etc.).

The oxidation or decarburization of steel in a reheat furnace thus results in a loss of raw material, which is called "loss on ignition", and a degradation of the surface properties of products, which are prejudicial to the steelmaker.

A major constraint, which will also affect the final quality of the product at the end of the reheat process, is the final temperature of the product and its thermal homogeneity, this being so whatever the heating history that has taken place in the furnace (time spent at certain temperature levels, slower production rate following a rolling mill incident, etc.). Any lack of thermal inhomogeneity will cause structural defects and a posteriori mechanical embrittlement of the finished products. These defects may also cause certain parts of the rolling mill (especially rolling-mill stands) to be stopped or even broken.

Any optimization of the metallurgical quality of the product must meet this constraint with regard to the thermal homogeneity of the product. During operation of the furnace by the operator, control of and compliance with the temperature rise of the product are key factors in ensuring in the end that the thermal homogeneity constraint is met.

A person skilled in the art knows that, to avoid decarburization and oxidation, it is recommended to work in a protected atmosphere by substoichiometric combustion (using a fuel-rich mixture generating a neutral or even reducing atmosphere with respect to steel). This method is employed in galvanizing processes (see, for example, *Galvanisation et aluminiage en continu* [Continuous galvanizing and aluminizing] by E. Buscarlet, *Technique de l'ingénieur* [Engineering Techniques], 1996.

It is also known, from U.S. Pat. No. 4,415,415, to treat products in an atmosphere containing at least 3% oxygen by volume, and to do so over the entire length of the furnace, thereby inevitably resulting in the formation of scale but making it possible to control the quality of the scale, which, under these conditions, becomes non-adherent and easily removable.

Patent EP-A-0 767 353 also proposes to vary the furnace atmosphere by zoning the furnace, that is to say by isolating the furnace into several chambers within which a highly oxidizing atmosphere is recommended, so as to be able to control the formation and quality of the scale. In this case, the loss on ignition is not reduced, but on the contrary is increased, only the quality of the scale being controlled.

The various methods known from the prior art therefore suggest that the products either be treated in an oxidizing atmosphere or in a reducing atmosphere.

The use of these various methods also has an additional drawback in the case of the treatment of steel products. This is because it is important to be able to measure the oxidizing or reducing character of the atmospheres involved. The only information available during implementation of these processes is provided by measurement probes located either in the roof, that is to say far from the surface of the products, or in the flue of the furnace. These measurements are therefore not representative of the composition of the atmosphere which interacts directly with the product. In general, the only measurable parameter of the atmosphere is the oxygen content. This information is generally insufficient—because the fact that the amount of oxygen in the smoke leaving the furnace is zero does not necessarily mean that the furnace atmosphere in contact with the metal workpieces is reducing with respect to steel (see, for example, *Combustion Engineering and Gas Utilisation*, published by British Gas, 1992, page 23). According to the Applicant, the species $H_2O$ and $CO_2$ also have an oxidizing role on the charge and are involved in scale formation reactions and in decarburization mechanisms. At the present time, it is not known how to measure these species simply and quickly.

To operate the furnace and meet the final constraint of thermal homogeneity of the product, the operator adopts an initial temperature profile of a given product for a given furnace, depending on the type of charge and of production. This profile is either known to the operator, because of his know-how, or is calculated from charts, or else calculated using suitable software.

The only information available for the operator and/or the furnace operation software are the measurements delivered by one or more thermocouples located in the roof of the furnace. These thermocouples are placed far from the charge and are not representative of the heat flux received by the charge beneath the burners. It is therefore necessary to estimate the relationship which links the roof temperature (which is measured) and the temperature of the charge (useful information). This relationship is either empirical (based on the operator's know-how) or calculated using furnace operation software.

Not only is this measurement only an indirect measurement of the necessary information, but the estimated relationship may prove to be less and less accurate upon aging of the furnace, of the thermal characteristics of the various charges and variations in the type of fuel used.

Finally, this measurement is a measurement at a certain point, usually located on the axis of the furnace and it does not take into account possible variations in said parameter over the entire width of the furnace.

The fact of not having measurements made as close as possible to the product has the consequence that the characteristic times of the process for heating these products is not known exactly. Yet it has been found that these characteristics have a major influence on the oxidation and decarburization kinetics of said products, it being possible that an incorrect estimation of these times has serious consequences as regards the final metallurgical quality of the product.

SUMMARY OF THE INVENTION

The aim of the present invention is to provide a method of operating a furnace (temperature, composition of the atmosphere) and an associated control procedure, making it possible to optimize both the metallurgical quality of a product and the loss on ignition and thermal efficiency of a furnace.

FIGURES

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
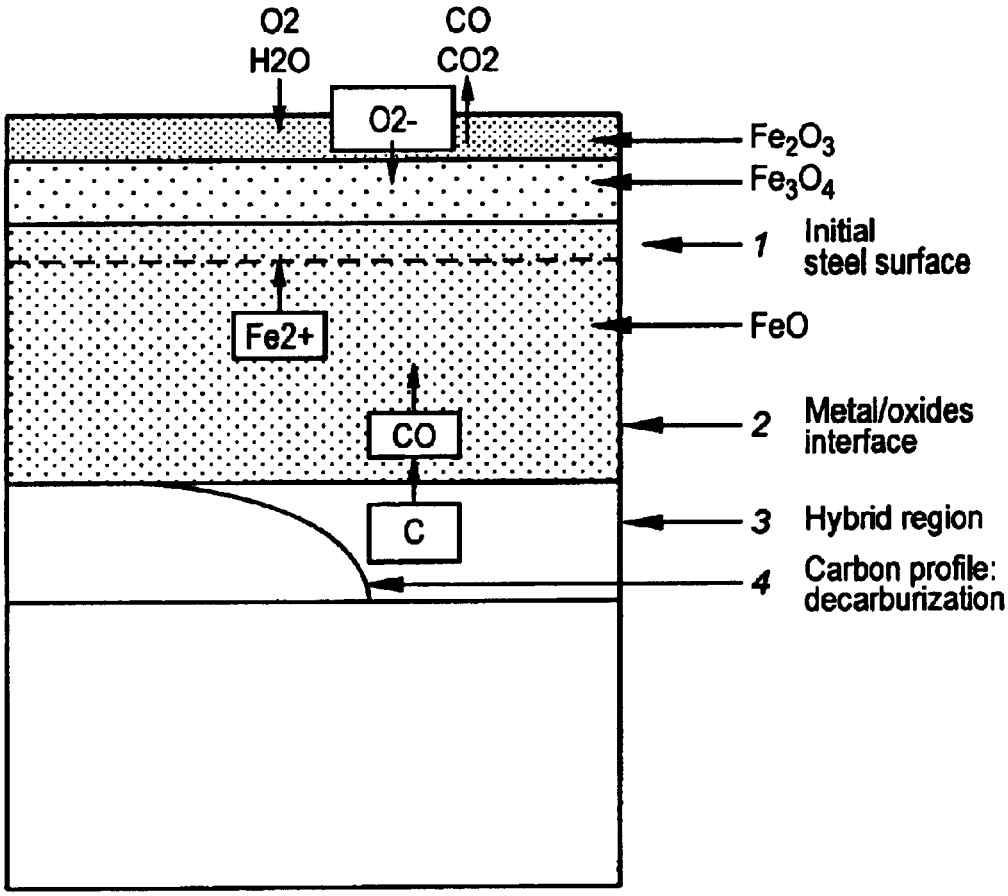
FIG. 1 shows an altered region at the surface of the workpiece which is essentially composed of two parts.

The method according to the invention makes it possible to avoid the aforementioned drawbacks and allows the abovementioned aim to be achieved.

The method according to the invention is characterized in that the product to be treated has a temperature that increases between the moment when it is introduced into the furnace and the moment when it is removed therefrom, the temperature rise curve having a slope that increases over a first time interval between the time $t_0$ of introduction of the product into the furnace and the time $t_1$ at which the product achieves a surface temperature of 650° C., an approximately constant slope between the time $t_1$ and the time $t_2$ at which the product reaches a temperature about 15% below the desired final surface temperature of the product to be treated when it leaves the furnace, then a slope that decreases between the time $t_2$ and the time $t_3$ at which the product to be treated leaves the furnace, in which method the heating power of the furnace is increased relative to its power when only air/fuel burners are used, so as to increase the slope of the curve giving the rise in temperature of the product to be treated, at least during certain periods of treatment of the product in the furnace between the times $t_1$ and $t_2$, thereby reducing the duration of the treatment of the product to be treated and correspondingly reducing the thickness of the decarburized layer and/or the layer of scale formed on the surface of the product.

Preferably, the increase in the heating power of the furnace is obtained by means of oxyfuel burners that constitute at least part of the heating means of the furnace, especially part of the heating means of the furnace corresponding to the zone reached by the product between the times $t_1$ and $t_2$. It is also possible place this or these oxyfuel burners in a zone adjacent the abovementioned zone, which would make it possible for the same increase in power (in said zone reached by the product between the times $t_1$ and $t_2$) to be obtained indirectly.

In general, the oxidizer delivered to the oxyfuel burners, constituting at least part of the heating means of the furnace, contains at least 88% oxygen, preferably greater than 90% oxygen and even more preferably greater than 95% oxygen.

In general it is found that the time for treating the product between the temperatures of 700° C. and 800° C. reached by the surface of the product is reduced by 15% to 50% of its reference value, preferably by 20 to 35% of its value, whereas the treatment time between the temperatures of 700° C. and the final temperature of the surface of the product is reduced by between 3 and 25% of its reference value, preferably between 7 and 15% of its reference value.

Preferably according to the invention, used by itself or in combination with the other variants of the invention, the atmosphere of the furnace varies along the length of the furnace as a function of the skin temperature of the metallic product.

According to a first variant of the invention, used alone or in combination with the other variants of the invention, the atmosphere of the furnace on contact with the product to be treated contains about 0.5 to 5 vol % oxygen and preferably between 1.5 to 4 vol % oxygen when the skin temperature T at the surface of the treated product is greater than or equal to the equalization temperature $T_{equalization}$, which is equal to 85% of the temperature at the surface of the product (discharge temperature) as it leaves the furnace. Preferably, the equalization temperature $T_{equalization}$ is equal to 90% of the discharge temperature.

According to another variant of the invention, used by itself or in combination with the previous ones, the atmosphere on contact with the product to be treated has an oxygen concentration of less than a few hundred ppm and a CO concentration of between 0.1 and 15 vol %, preferably 0.5 to 5 vol %, when the skin temperature T at the surface of the product is above 700° C. and below the equalization temperature of the product, defined as being equal to 90% of the skin temperature of the product as it leaves the furnace.

According to yet another variant of the invention, used by itself or in combination with the previous ones, the atmosphere in contact with the product to be treated has an oxygen concentration of between 0.5 and 4 vol % and preferably between 2 and 3 vol % when the skin temperature T at the surface of the product to be treated is below 700° C.

The invention allows the metallurgical quality of products to be optimized by optimizing the heating profile in the furnace together with improved control of the composition profile of the atmosphere in the furnace. This control continuously monitors the $O_2$ and/or $H_2O$ and/or $CO_2$ contents of the atmosphere in the various zones of the furnace, and/or the temperature at the surface of the products to be treated, will preferably be carried out using a diode laser. This TDL (Tunable Diode Laser) system makes it possible in fact to measure the average concentrations of gaseous species along the length of the optical path of the laser beam. For further details about diode lasers and in particular TDL-type diode lasers, reference may be made to the article by Mark G. Allen entitled "Diode Laser Absorption Sensors for Gas Dynamic and Combustion Flows", *Mes. Sci. Technology,* 9, 1998, pages 545 to 562, and incorporated in the present text as reference. In general, these diode lasers are laser radiation sources, some of which operate at room temperature while others must be cooled. The laser beam emitted can in general be tuned within a wavelength range by varying the current injected into the laser source. All that is then required is to choose laser beam sources that can be tuned within wavelength ranges which correspond to at least one of the characteristic lines of the absorption spectrum of the species which it is wished to detect. Preferably, the diode laser will be placed near the surface of the products, at a distance varying between 1 mm and 15 cm, preferably between 2 cm and 6 cm. It is in the region of the surface of the product that the $O_2$, $H_2O$ and $CO_2$ partial pressures thus of the temperature are involved in the mechanisms described above, namely scale formation and decarburization. This monitoring as close as possible to the surface also makes it possible for predictive tools to be developed and for the method proposed to be implemented properly.

Figure 2:
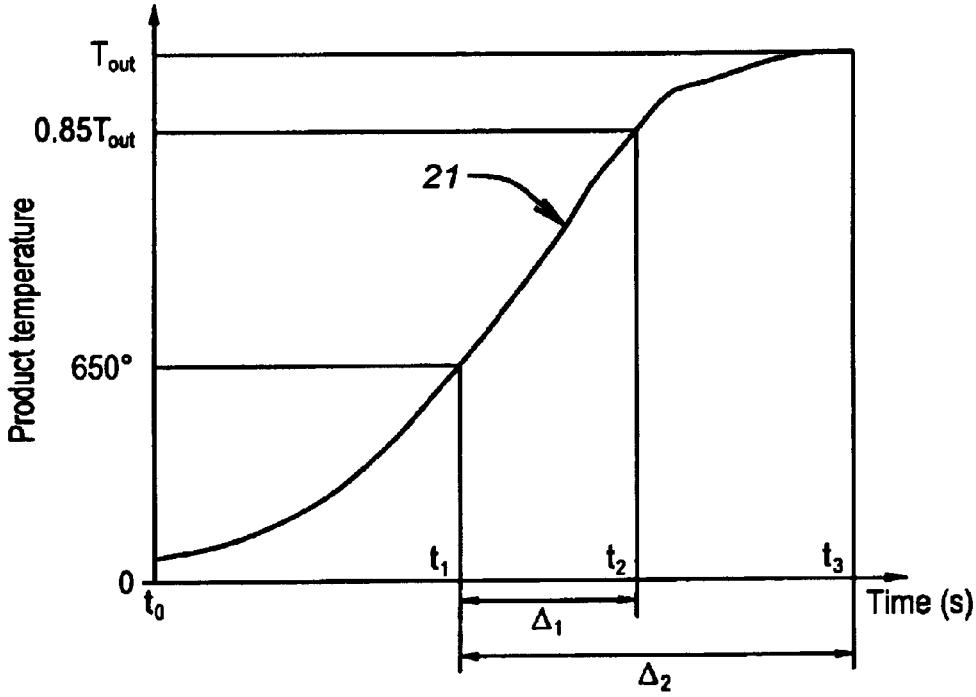
FIG. 2 shows a characteristic curve of the variation in temperature of the product as a function of time, controlled according to the method of the invention.
Figure 3:
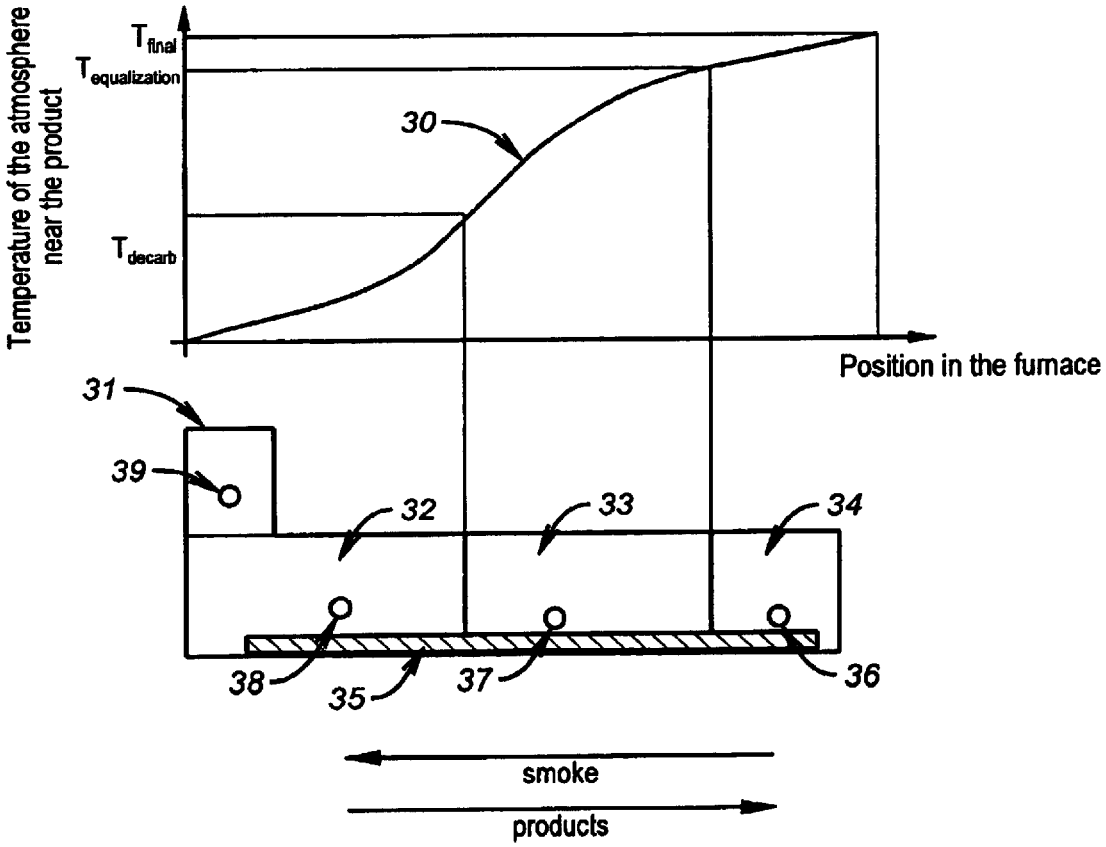
FIG. 3 shows the application of the invention to a reheat furnace.
Figure 4:
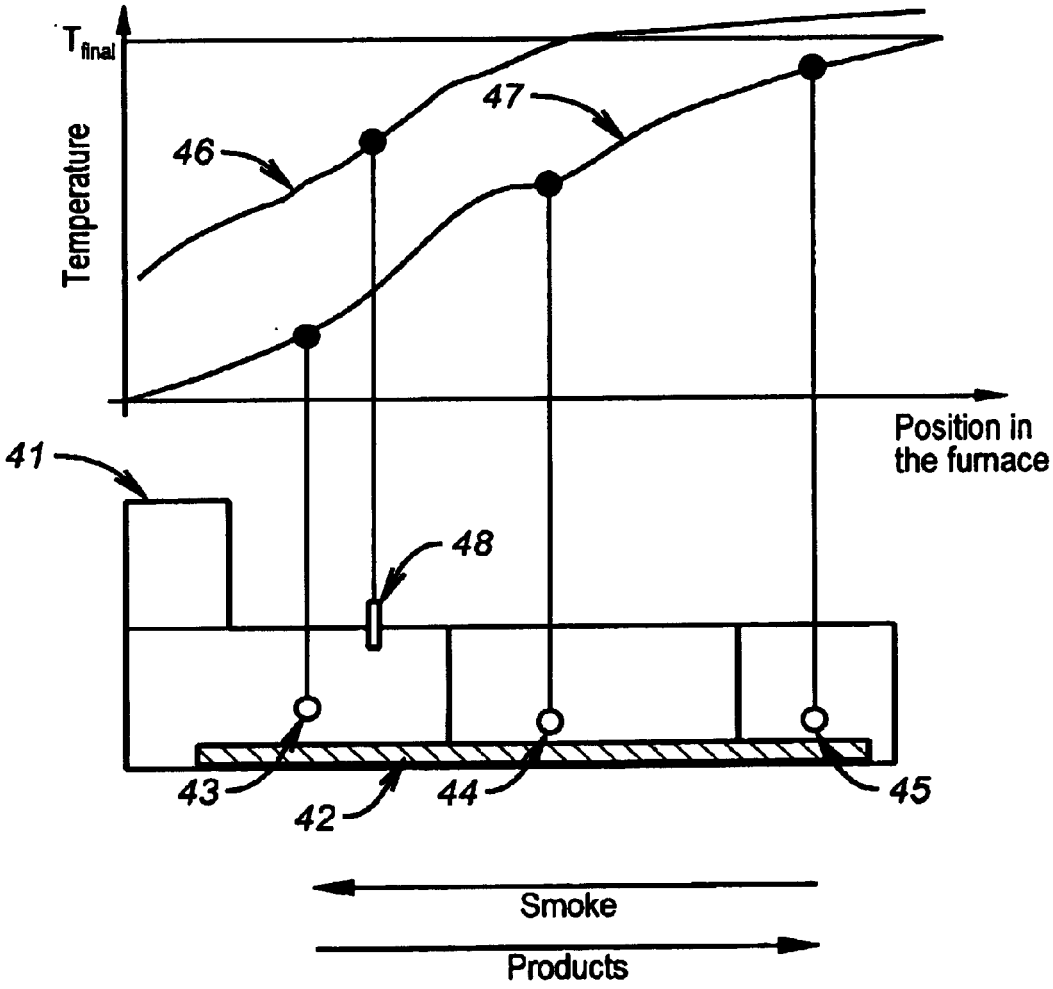
FIG. 4 shows the control, according to the invention, of the temperature rise of the product.
Figure 5:
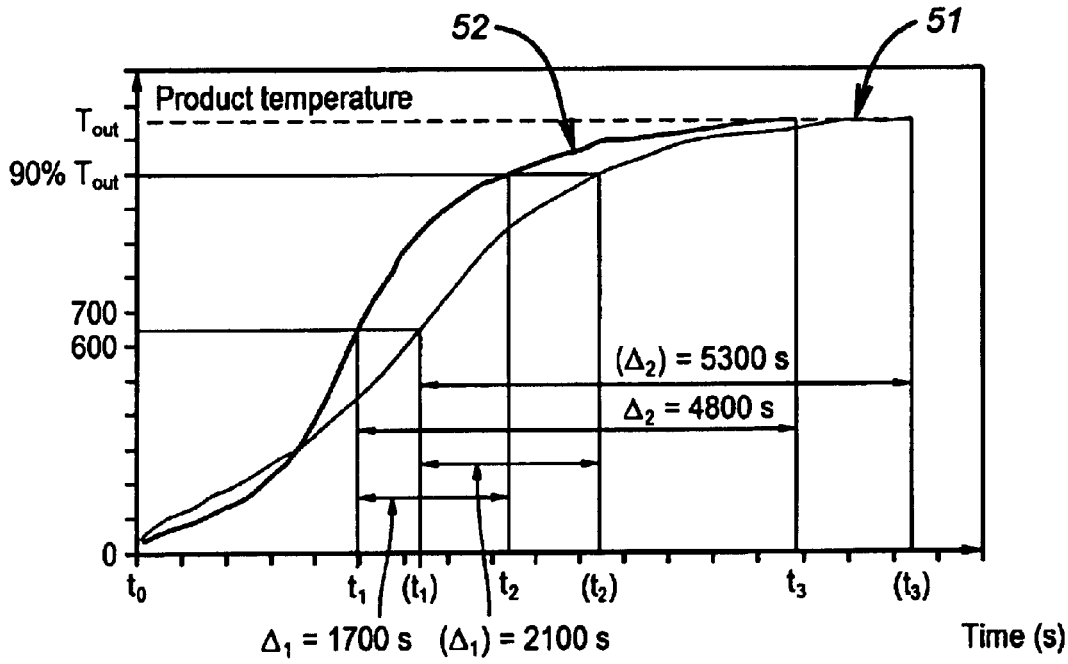
FIG. 5 shows a curve of the temperature in a reheat furnace as a function of time.
Figure 6:
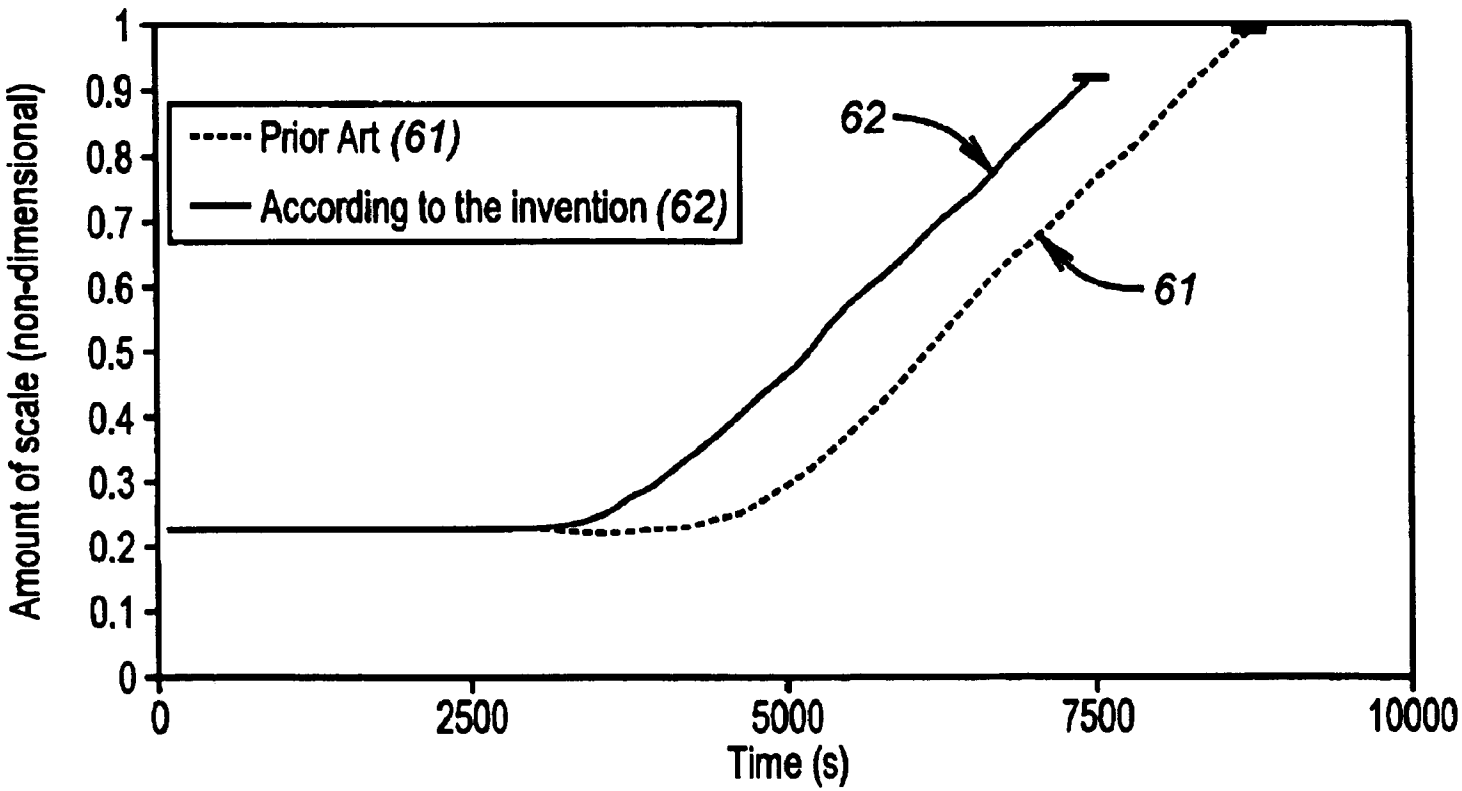
FIG. 6 shows a curve of the variation in the amount of scale as a function of time.
Figure 7:
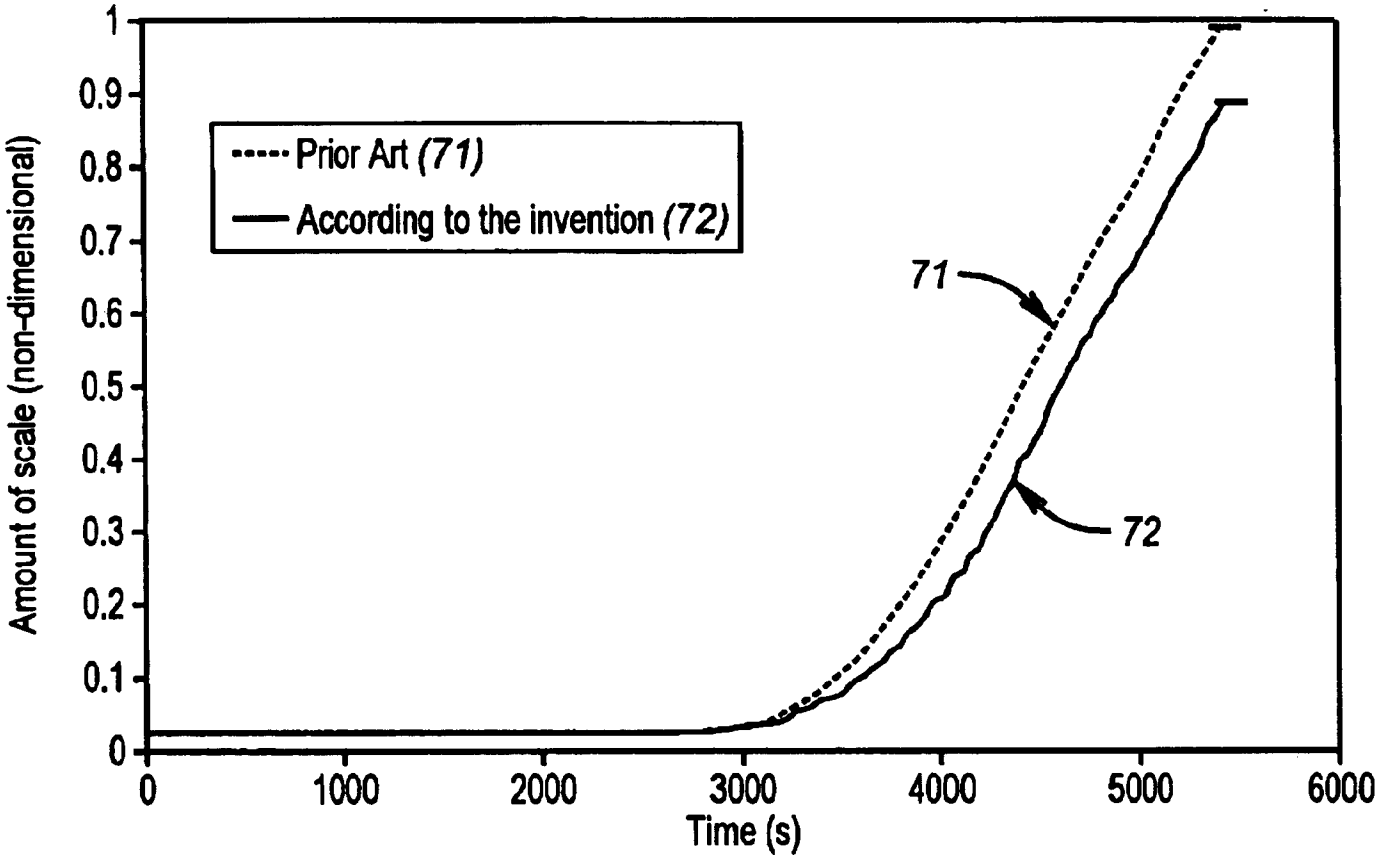
FIG. 7 shows another curve of the variation in the amount of scale as a function of time.

A greater understanding of the invention will be gained from the following illustrative examples, given without implying any limitation, in conjunction with the figures which show:

FIG. 2 shows a characteristic curve of the variation in temperature of the product as a function of time, controlled according to the method of the invention;

FIG. 3 shows the application of the invention to a reheat furnace;

FIG. 4 shows the control, according to the invention, of the temperature rise of the product;

FIG. 5 shows a curve of the temperature in a reheat furnace as a function of time;

FIG. 6 shows a curve of the variation in the amount of scale as a function of time;

FIG. 7 shows another curve of the variation in the amount of scale as a function of time.

In FIG. 2, the curve (21) represents the heat-up curve of the product, for example the skin temperature of a billet or of a slab in a reheat furnace. According to this curve, it is possible to define the times $t_0$, $t_1$, $t_2$ and $t_3$ corresponding, respectively, to the time $t_0$ when the product is introduced into the furnace, to the time $t_1$ when the skin temperature reaches 650° C., to the time $t_2$ when the skin temperature is equal to 85% of the final (or discharge) temperature $T_{out}$ of the skin of the product and, finally, to the time $t_3$ when the product is discharged at its final temperature $T_{out}$. Thus, a time interval $\Delta_1$ corresponding to the time that the surface of the product spends between $t_1$ and $t_2$ is defined. A time $\Delta_2$ corresponding to the time spent by the product between $t_1$ and $t_3$ may also be defined.

The method according to the invention consists in reducing the time $\Delta_1$ by about 8% to 40% of its reference value and preferably by about 10% to 30% of its reference value. This allows the thickness of the decarburized layer to be decreased by at least 20%, depending on the contents of the alloying elements and specifically the carbon content, compared with the method of the prior art using either the empirical operation of the furnace by an experienced person skilled in the art or the operation of the furnace using temperature charts or suitable software. It is in particular the reduction in the time $\Delta_1$, resulting in an increase in the slope of the curve 52 compared with the slope of the curve 51 between the times $t_1$ and $t_2$ corresponding to the temperatures of 650° C. and of 85% of the skin temperature at the exit of the furnace, which is fundamental according to the method of the invention, as it has been demonstrated that it is in these temperature ranges that it is necessary to increase the slope of the heat-up curve of the product if it is desired to obtain the hoped-for reductions.

Likewise, the invention makes it possible to reduce the time $\Delta_2$ by between 5 and 30% of its reference value and preferably by between 7 and 15% of its reference value. This makes it possible to decrease the mass of the scale by between 5 and 30%, depending on the nature of the steel.

This reduction in the times $\Delta_1$ and $\Delta_2$ is achieved, according to the invention, by increasing the energy transferred to the product throughout the duration of its residence in the furnace. This may be achieved by increasing the available energy (by adding an energy source, via naked-flame burners, radiant tubes or else electrical resistance elements or induction heating) or by increasing the efficiency of the available energy (by enriching the combustion air up to, for example, oxygen, up to a purity of up to 100%), preferably to above 90 vol % Of $O_2$.

The maximum reduction of $\Delta_2$ is fixed by having to meet the constraint of thermal homogeneity of the product on leaving the furnace, this constraint itself being governed by the thermal conduction within the product.

Compared with a given reference situation (given furnace and given hourly production, and therefore given run speed, of given products), the reduction in times $\Delta_1$ and $\Delta_2$ corresponds either to a shortening of the furnace or to an increase in the run speed of the products.

A second aspect of the invention consists in controlling the composition profile of the species of the atmosphere in the furnace and along the entire length of the path traveled by the product through the furnace.

As a matter of fact, the composition of the atmosphere, that is to say especially the contents of the oxidizing components ($O_2$, $H_2O$, $CO_2$) in the atmosphere, is a parameter which has an impact on the metallurgical quality of the product. Thus, for a given thermal profile, it is possible to optimize the quality of the product by maintaining a higher or lower oxygen content depending on the furnace zone in question.

In FIG. 3, which shows a reheat furnace, the direction in which the products (35) run and the flow direction of the smoke are indicated. Curve (30) is the curve showing the temperature rise of the product.

As the charge (35) runs through the reheat furnace, it undergoes a first temperature rise in the zone (32). The temperatures then reach a temperature $T_{decarb}$. This temperature is typically 700° C. in the case of steels and the sensitivity of the decarburization to this temperature is greater the higher the carbon content of the steel. Above $T_{decarb}$, and in the presence of oxidizing species, the decarburization and scale formation reaction rates increase: the temperature at which scale formation becomes effective is about 800° C. in the case of steels. The product passes through the zone (33) and then enters the equalizing zone (34), when the product is at the temperature $T_{equalization}$ (typically 1100° C.). This zone, at very high temperature, brings the product to its final temperature ($T_{final}$, typically 1200° C.), and is particularly critical for the formation of scale.

Three ports for installing a diode laser are provided on this furnace. The port (36) is located in the equalizing zone (34), the port (37) is located in the heating zone (33), the port (38) is located in the zone (32) which contains the zone called the recovery zone, whereas the port (39) is located in the flue (31).

According to the invention, the concentration of the oxidizing species is measured by the ports (36), (37), (38), (39), each port receiving a laser beam (via an optical fiber), or a laser beam emitter, a receiver being provided in the opposite wall of the furnace (or else a mirror which sends the beam back parallel to the incident beam, the receiver being placed beside the emitter).

In the zone (32) (temperature below $T_{decarb}$), the fuel and oxidizer flow rates for the burners in the zone (32) must be adjusted, according to the invention, so as to create an oxygen content in the atmosphere in this zone (32), measured by the corresponding diode laser, of between 0.5 and 4 vol % and preferably between 2 and 3 vol %.

If the equalizing zone (32) is not fitted with burners, this correction may be made by the addition of oxidizer via lances, for example oxygen lances, the amount injected being controlled by the measurement of the oxygen content by the diode laser.

The measurement is preferably carried out as close as possible to the product, either via the port (38) in this zone (32) or via the port (39), that is to say in the smoke extraction duct where the same oxygen content is monitored. If the measurement shows a lack of oxygen, this lack must be corrected by regulating the burners, hence increasing the rate of flow of oxidizer (oxygen) to the burners of the zone (32) or of the preceding zone.

In zone (32), a protective layer of $Fe_2O_3$ and $Fe_3O_4$ will be formed and reinforced by the presence of residual oxygen in the smoke. These oxides will be formed to the detriment of more plastic oxides such as FeO or $FeSiO_4$ which in this case result in strong adhesion of the scale. In addition, at low temperature, the protective conditions (in the parabolic stage of the oxidation) are established more quickly for oxygen partial pressures lying within the aforementioned range (0.5 to 4 vol %).

In the zone (33) (temperature above $T_{decarb}$ but below $T_{equalization}$), the fuel and oxidizer flow rates for the burners in the zone (33) must be regulated according to the invention so as to produce an oxygen content close to zero in the atmosphere. The atmosphere will be depleted in oxygen, and therefore the fuel, and in particular the CO, will be in excess. Thanks to the measurement carried out via the port (37), the burners will be regulated in such a way that the $O_2$ concentration is close to zero and the CO concentration is between 0.1 and 15 vol % and preferably between 1 and 10 vol %. In this higher-temperature zone, it is desired to limit scale formation and decarburization as much as possible, by reducing the concentration of the oxidizing species ($O_2$, $CO_2$, $H_2O$).

In the zone (34) (temperature above $T_{equalization}$) the fuel and oxidizer flow rates for the burners in the zone (34) must be regulated according to the invention so as to produce an oxygen content in the atmosphere of between 0.5 and 5 vol % and preferably between 1.5 and 4 vol %. The measurement of this concentration is made as close as possible to the product, between 1 mm and 15 cm therefrom, via the port (36). In this zone and in the presence of oxygen, there is consumption of the decarburized layer by oxidation, which will be accompanied by an increase in porosity of the scale, which will facilitate its removal outside the furnace.

The port (39) is used to check at all times the CO concentration and the $O_2$ concentration in the smoke before it is discharged.

When the atmosphere is controlled in this way, according to the invention, the mass of scale is reduced by between 5 and 25%, depending on the nature of the steel.

Likewise, as a general rule it may be noted that the thickness of the decarburized layer is reduced by at least 10%, depending on the contents of the alloying elements and specifically the carbon content.

The gains obtained by controlling the atmosphere are concurrent with the gains made by reducing the times $\Delta_1$ and $\Delta_2$ described above.

FIG. 4 illustrates the monitoring according to the invention of the temperature rise of the product. The invention consists in monitoring the temperature rise of the product and in regulating the burners, by means of a local measurement, zone by zone and a few cm above the charge, of the temperature of the atmosphere in the furnace using a diode laser system.

FIG. 4 shows, in the furnace (41), the position of the product (42) and of the thermocouple (48) according to the prior art. The measurement by the thermocouple (48) gives a temperature value on the axis of the furnace but far from the product (42).

According to the invention, one or more diode lasers are fitted in order to measure an average temperature value along the optical path over the width of the furnace. Such an arrangement allows:

an average measurement to be made along the furnace, this being more representative of the product than a discrete measurement in the roof;

a measurement close to the product, and therefore directly associated with the surface temperature of the product which is in equilibrium with the temperature of the gas in contact with the said surface;

quantification of the relationship between roof temperature and product temperature, which in the prior art was established empirically (by retaining the roof thermocouple).

In FIG. 4, the number of measurement points has been limited here to three. Preferably, between 1 and 10 measurement points in a furnace will be used.

The furnace (41) is fitted with ports (43, 44, 45) located above the product (42).

The furnace operator must comply as closely as possible with the temperature rise profile (47) of the product. This profile is supplied to the operator, either through his experience, or by means of a chart or via furnace operation software.

To control the product temperature rise (47), a person skilled in the art hitherto had available only the curve (46) indicating the roof temperature along the axis of the furnace, the thermocouple (48) of which delivers, for example, a measurement point as illustrated on the curve. According to the invention, a person skilled in the art now can obtain measurements located along the curve (47) which are directly associated with the surface temperature of the product. The operator can therefore vary the power of the burners in order to find the desired temperature level on the curve (47). If the measured temperature is too low, the operator will then increase the heating power in the zone close to the measurement point. Conversely, if the measured temperature is too high, the operator will then reduce the power in the zone close to the measurement point.

The invention also has the following advantage: Certain furnaces use software called "Niveau 2 [Level 2]" to reproduce, whatever the heating conditions, a product temperature rise, according to a given initial profile. Until now, a person skilled in the art did not have available any measurement for continuously confirming the effect of the software. It is another aspect of the invention that this software is coupled with the direct measurements of the product according to the invention, thereby making it possible to systematically verify in real time the intended temperature of the product.

EXAMPLES

Example 1

A first illustrative example is described with the aid of FIG. 5, which shows the heating curve (51) associated with a long billet reheat furnace. The combustion is carried out using burners, the fuel for which is natural gas and the oxidizer for which is preheated air, before implementation of the invention. (In this FIG. 5, the parameters $t_1$, . . . and $\Delta_1$, . . . are in parentheses when they relate to curve 51 according to the prior art and are without parentheses when they refer to curve 52).

Implementation of the invention is characterized by replacing the existing burners, the oxidizer for which is air, with burners for which the oxidizer has an oxygen concentration of greater than 21 vol %, and preferably greater than 88 vol %. More preferably, the oxidizer will be industrially pure oxygen. The associated heating curve is the curve (52).

It should be noted that the times $\Delta_1$ and $\Delta_2$ are reduced from 2100 to 1700 seconds and from 5300 to 4800 seconds, respectively. The metallurgical quality of the method obtained according to the curve (52) will be greatly enhanced by monitoring the heating curve in FIG. 5, with the installation of diode lasers at the locations explained with regard to FIG. 3 and FIG. 4 or any measurement means allowing this heating profile to be suitably controlled.

FIG. 6 shows the amount of scale produced using the method described above. The amount of scale (61) is associated with the reference situation and the scale curve (62) is associated with the implementation of the invention. The two curves have been normalized with respect to the maximum value of the scale thickness obtained under the conditions (61).

Implementation of the method according to the invention, which reduces $\Delta_1$ by 19% and $\Delta_2$ by 9.5%, makes it possible to reduce the amount of scale by 8% on average (FIG. 6). Depending on the experiments, the thickness of the decarburized layer is reduced by between 9 and 17%.

Example 2

The illustrative example below was implemented in a billet reheat furnace having a power of 33 MW and a length of about 30 m. The burners originally present in the furnace were burners called air-fuel burners, the combustion air being preheated to 300° C.

FIG. 7 compares, for an identical heating profile, the amount of scale produced (curve 71) with a heating atmosphere whose oxygen concentration in the wet smoke is constant and equal to 3.5 vol %, and the amount of scale produced (curve 72) with a heating atmosphere whose oxygen concentration in the wet smoke varies in the following manner:

about 1.5% $O_2$ (to within 20%) when the skin temperature T is above the equalization temperature $T_{equalization}$ (defined as being between 85% and 90% of the discharge temperature);

about 0% $O_2$ (up to a few hundred ppm) and a CO concentration of between about 0.5 and 3% (to within 20%) for $T_{decarb}<T<T_{equalization}$, $T_{decarb}$ being the decarburization start temperature (700° C.); and about 2% $O_2$ (to within 20%) when the skin temperature T is below $T_{decarb}$.

The mean $O_2$ concentration in the smoke may be measured by a standard oxygen probe, but it may be preferable to employ a diode laser (of the "TDL" type), the beam of which passes at a distance of less than about 6 cm from the treated product, for fine monitoring, in real time, of a variation in concentration of the species above at the surface of the product so as to better meet the atmosphere profile set in order to match the heating profile.

According to this Example 2, implementation according to the invention allows the thickness of the scale to be reduced by 11% (FIG. 7). Depending on the experiments, the thickness of the decarburized layer is reduced by between 12 and 20%.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above and/or in the figures.

What is claimed is:

1. A method for treating a metallurgical product in a furnace, comprising the steps of:

i) introducing said product into said furnace at time $t_0$;

ii) subjecting said product to the desired treatment before being removed from said furnace at time $t_3$;

iii) increasing the temperature of said products to about 650° C. during the period ($t_1$–$t_0$), wherein $t_1$ represents the time at which the surface temperature is reached;

iv) increasing the temperature of said product almost uniformly to about 85% of the desired final temperature ($T_{equalization}$) during the period $t_2$–$t_1$, wherein $t_2$ represents the time at which the temperature of said product is reached;

v) increasing the temperature of said product at a decreasing rate to said desired final temperature during the period ($t_3$–$t_2$); and vi) enhancing the metallurgical quality by reducing the thickness of scales or decarburized layer formed on the surface of said product.

2. The method according to claim 1, wherein said method further comprises:

vii) isolating said furnace into various zones of identical or different composition;

viii) raising the temperature of the zones to a variable temperature by heating via burners; and ix) increasing the heating power relative to only when air/fuel burners are utilized.

3. The method according to claim 2, wherein said heating power is generated by oxyfuel burners that constitute at least part of the heating means of the furnace.

4. The method according to claim 3, wherein said heating power corresponds to the zone that ranges from time $t_1$ to $t_2$.

5. The method according to claim 3, wherein said method further comprises the step of:

delivering an oxidizer to the oxyfuel burners, and wherein said oxidizer comprises at least about 88% oxygen.

6. The method according to claim 5, wherein said oxidizer comprises greater than about 90% oxygen.

7. The method according to claim 6, wherein said oxidizer comprises greater than about 95% oxygen.

8. The method according to claim 1, wherein the method further comprises: reducing the time for treating the product from about 700° C. to about 800° C. by about 15% to about 50% of the reference value, and wherein said reference value corresponds to the temperature value of the prior art.

9. The method accord according to claim 8, wherein said time is reduced from about 20% to about 35% of the reference value.

10. The method according to claim 1, wherein the method further comprises the step of: reducing the time for treating the product from about 700° C. to the final temperature by about 3% to about 25% of the reference value, and wherein said reference value corresponds to the temperature value of the prior art.

11. The method accord according to claim 10, wherein said time is reduced from about 7% to about 15% of the reference value.

12. The method according to claim 2, wherein the temperature of the furnace's atmosphere is based on the surface temperature of the metallurgical product.

13. The method according to claim 12, wherein said atmosphere comprises from about 0.5% to about 5 vol % oxygen.

14. The method according to claim 12, wherein said furnace comprises:

i) about 1.5% to about 4 vol % oxygen in said atmosphere; and ii) surface temperature T that is greater than or equal to said $T_{equalization}$, and wherein said $T_{equalization}$ is equal to about 85% of the surface temperature T of the product as it leaves the furnace.

15. The method according to claim 14, wherein said $T_{equalization}$ is equal to about 90% of the discharge temperature, and wherein said discharge temperature is the temperature of the product as it leaves the furnace.

16. The method according to claim 1, wherein the atmosphere comprises:

i) an oxygen concentration of less than a few hundred ppm;

ii) a CO concentration from about 0.1% to about 15% vol when the surface temperature is above about 700° C. and below said $T_{equalization}$ of the product, and wherein said $T_{equalization}$ is equal to about 90% of the discharge temperature.

17. The method according to claim 16, wherein said CO concentration ranges from about 0.5% to about 5% vol.

18. The method according to claim 1, wherein the atmosphere comprises an oxygen concentration that ranges from about 0.5% to about 4% vol when the surface temperature is below about 700° C.

19. The method according to claim 18, wherein said oxygen concentration ranges from about 2% to about 3% vol.

20. The method according to claim 1, wherein the method further comprises means of analyzing at least one parameter of the atmosphere by utilizing a diode laser, and wherein the beam of said laser is located at a minimum distance ranging from about 1 cm to about 6 cm to the product's surface.

21. The method according to claim 1, wherein said method comprising the steps of:

i) introducing said product into said furnace at time $t_0$;

ii) subjecting said product to the desired treatment before being removed from said furnace at time $t_3$;

iii) increasing the temperature of said products to about 650° C. during the period ($t_1$–$t_0$), wherein $t_1$ represents the time at which the surface temperature is reached;

iv) increasing the temperature of said product almost uniformly to about 85% of the desired final temperature ($T_{equalization}$) during the period $t_2$–$t_1$, wherein $t_2$ represents the time at which the temperature of said product is reached;

v) increasing the temperature of said product at a decreasing rate to said desired final temperature during the period ($t_3$–$t_2$); and vi) enhancing the metallurgical quality by reducing the thickness of scales and decarburized layer formed on the surface of said product.

* * * * *